US010378166B2

(12) United States Patent
Impero et al.

(10) Patent No.: US 10,378,166 B2
(45) Date of Patent: Aug. 13, 2019

(54) DEFORMATION GUIDING SYSTEM FOR A ROAD SAFETY DEVICE AND A ROAD SAFETY DEVICE GROUP

(71) Applicant: Pasquale Impero, Casalnuovo di Napoli (IT)

(72) Inventors: Pasquale Impero, Casalnuovo di Napoli (IT); Luigi Grassia, Lusciano (IT)

(73) Assignee: PASQUALE IMPERO, Casalnuov o di Napoli (IT)

( * ) Notice: Subject to any disclaimer, the term of this patent is extended or adjusted under 35 U.S.C. 154(b) by 0 days.

(21) Appl. No.: 15/768,781

(22) PCT Filed: Oct. 21, 2016

(86) PCT No.: PCT/IB2016/056342

§ 371 (c)(1),
(2) Date: Apr. 16, 2018

(87) PCT Pub. No.: WO2017/068539

PCT Pub. Date: Apr. 27, 2017

(65) Prior Publication Data

US 2018/0298572 A1 Oct. 18, 2018

(30) Foreign Application Priority Data

Oct. 22, 2015 (IT) ..... 102015000064296

(51) Int. Cl.
*E01F 15/14* (2006.01)

(52) U.S. Cl.
CPC ..... *E01F 15/146* (2013.01)

(58) Field of Classification Search
CPC ... E01F 15/0461; E01F 15/086; E01F 15/146; E01F 9/541; E01F 9/692
See application file for complete search history.

(56) References Cited

U.S. PATENT DOCUMENTS 4,815,565 A * 3/1989 Sicking ..... E01F 15/146 256/1
5,868,521 A * 2/1999 Oberth ..... E01F 15/146 256/13.1

(Continued)

FOREIGN PATENT DOCUMENTS

CA 2917337 A1 5/2015
EP 1221508 A2 7/2002
WO WO 2013/01800 2/2013

*Primary Examiner* — Abigail A Risic
(74) *Attorney, Agent, or Firm* — R. Neil Sudol; Henry D. Coleman

(57) ABSTRACT

A deformation guiding system for a road safety device and a road safety device group, wherein the device has a frame and a deformable longitudinal body with a first end fixed to the frame and a second end. A head is fixable to the second end of the body. A guide rail is reciprocally arranged with respect to the deformable body for identifying a deforming direction thereof which is parallel to the guide rail. Coupling means fixed to the head couple the head to the guide rail for sliding motion along the guide rail. Stabilizing means fixed to the head prevent oscillations of the head about the guide rail. The coupling and stabilizing means are reciprocally arranged and conformed so that, in an impact of a vehicle against the head, the head can slide along the guide rail without oscillating about the guide rail so as to guide the deformation of the deformable body in the deforming direction.

7 Claims, 5 Drawing Sheets

(56) References Cited

U.S. PATENT DOCUMENTS

| | | | | |
|---|---|---|---|---|
| 6,905,281 | B2 * | 6/2005 | Kang | E01F 15/146 404/6 |
| 7,249,910 | B2 * | 7/2007 | Eckert | E01F 9/685 248/158 |
| 7,306,397 | B2 * | 12/2007 | Albritton | E01F 15/0423 404/6 |
| 8,226,321 | B2 * | 7/2012 | Meyers | E01F 15/003 404/6 |
| 8,469,626 | B2 * | 6/2013 | Thompson | E01F 15/146 404/6 |
| 8,596,903 | B2 * | 12/2013 | Hur | E01F 15/146 256/13.1 |
| 8,974,142 | B2 * | 3/2015 | Buehler | E01F 15/146 404/6 |
| 2010/0080652 | A1 * | 4/2010 | Shin | E01F 15/146 404/6 |
| 2011/0280656 | A1 * | 11/2011 | Meyers | E01F 15/003 404/6 |
| 2017/0362788 | A1 * | 12/2017 | Stevanato | E01F 15/146 |

* cited by examiner

DEFORMATION GUIDING SYSTEM FOR A ROAD SAFETY DEVICE AND A ROAD SAFETY DEVICE GROUP

FIELD OF THE INVENTION

The present invention relates to the technical sector concerning road safety devices.

In particular, the present invention relates to a deformation guiding system for a road safety device and a relative road safety device group

DESCRIPTION OF THE PRIOR ART

Road safety devices are arranged on the road surface and are designed for absorbing a part of the kinetic energy of a vehicle, in a case of impact of the vehicle against the road safety device.

Road safety devices (for example road impact attenuators or barrier terminals) are designed for placing in safety critical points of roads which otherwise would increase the risk of injury for the occupants of a vehicle in a case of impact.

A road safety device comprises a frame fixed to the road surface and a deformable longitudinal body which comprises a first end fixed to the frame and a second end opposite the first end.

A deformation guiding system for a road safety device is known. It comprises: a head fixable to a second end of the deformable body of the road safety device; a straight guide rail which guide rail and the deformable body of the road safety device are reciprocally arranged in such a way as to identify a deforming direction of the deformable body which is parallel to the straight guide rail; a coupling element fixed to the head for coupling the head to the guide rail so that the head can slide along the guide rail.

The coupling element of the head comprises a cavity internally of which the guide rail is inserted. In particular, the transversal section of the cavity of the coupling element has a shape alike that of the transversal section of the guide rail but having a greater area.

Therefore, in a case of a frontal impact of a vehicle against the head, the head slides along the guide rail so as to guide the deformation of the deformable body along the relative deforming direction.

However, in the hypothesis that a non-frontal impact occurs against the head (i.e. an impact that is such as to determine an impact force having a component that is parallel to the guide rail and a component that is perpendicular to the guide rail), the coupling element will press against the guide rail, producing a strong friction which will oppose the sliding of the head along the guide rail.

In this hypothesis, therefore, the guiding system of the deformation will be partially or totally ineffective with the corresponding increasing of danger for the occupants of the vehicle.

SUMMARY OF THE INVENTION

In the light of the above, the aim of the present invention consists in obviating the above-mentioned drawback.

The above aim is obtained with a guiding system of the deformation for a road impact attenuator according to claim 1 and by means of a road safety device group according to claim 6.

The deformation guiding system of the present invention, like the corresponding road safety device group, comprises stabilising means of the head, which prevent oscillations of the head about the guide rail: therefore, in a case of a non-frontal impact against the head, the stabilising means prevent the coupling means from going to press against the guide rail, producing a strong friction which would oppose the sliding of the head along the guide rail.

Therefore, in a case of a frontal or non-frontal impact of a vehicle against the head of the deformation guiding system of the invention, the head slides along the guide rail without oscillating about the guide rail so as to be able to guide the deformation of the deformable body to which it is fixed along the relative deforming direction.

The present deformation guiding system for a road safety device, and the relative road safety device group, are advantageously effective both for frontal impacts against the head and for non-frontal impacts against the head. This increases road safety which safeguards the well-being of the occupants of the vehicle.

BRIEF DESCRIPTION OF THE DRAWINGS

Specific embodiments of the invention will be described in the following part of the present description, according to what is set down in the claims and with the aid of the appended tables of drawings, in which:

DESCRIPTION OF THE PREFERRED EMBODIMENTS

Figure 1:
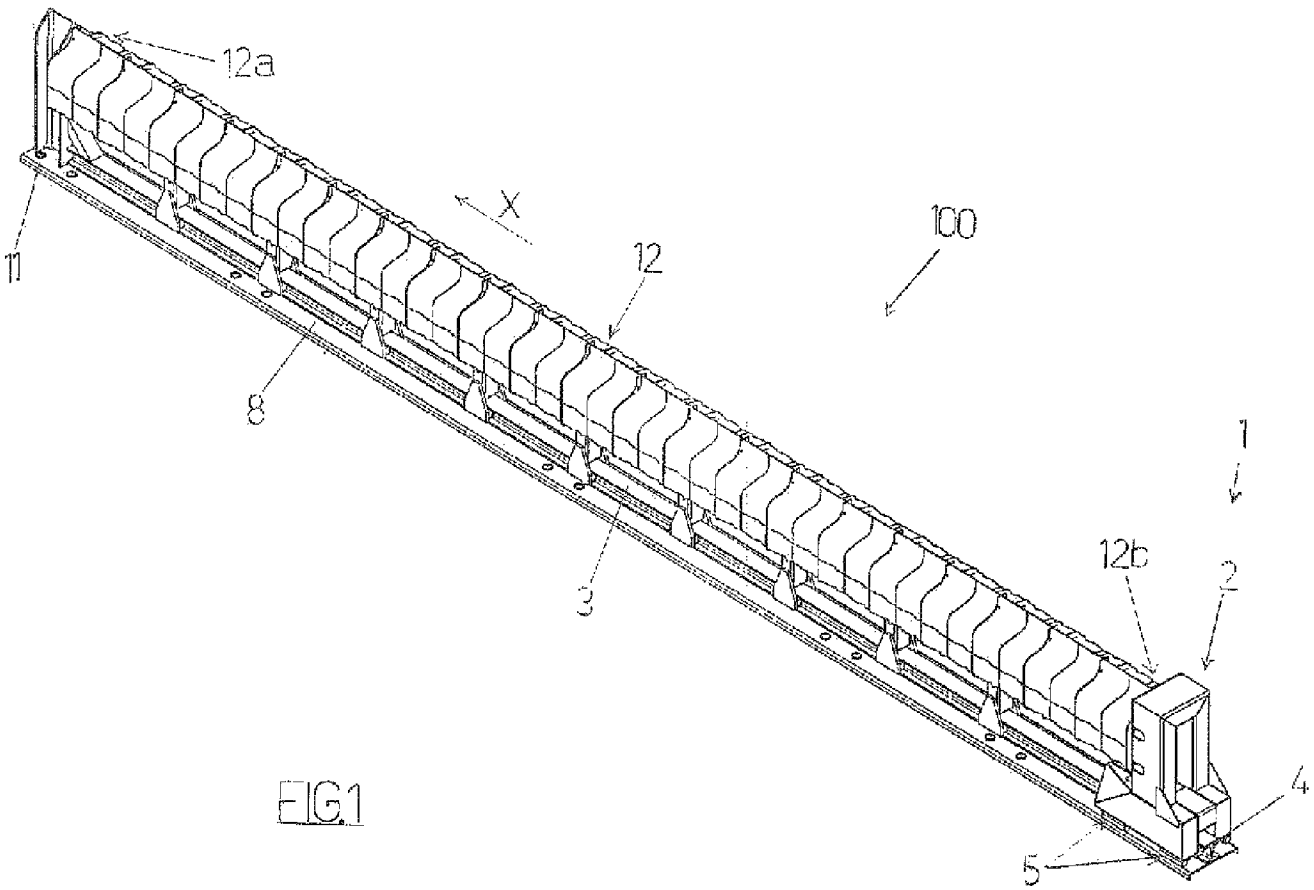
FIGS. 1 and 2 illustrate, respectively in a perspective and a frontal view, a road safety device group, object of the present invention.

With reference to the appended tables of drawings, reference numeral (1) denotes in its entirety a deformation guiding system for a road safety device object of the present invention, and reference numeral (100) denotes a road safety device group, also an object of the present invention.

A road safety device comprises a frame (11) fixed to the road surface and a deformable longitudinal body (12) which comprises a first end (12*a*) fixed to the frame (11) and a second end (12*b*) opposite the first end (12*a*).

The deformation guiding system (1) comprises: a head (2) fixable to the second end (12*b*) of the deformable body (12); a straight guide rail (3), which guide rail (3) and the deformable body (12) of the road safety device are reciprocally arranged in such a way as to identify a deforming direction (X) of the deformable body (12) which is parallel to the straight guide rail (3); coupling means (4) fixed to the head (2) for coupling the head (2) to the guide rail (3) so that the head (2) can slide along the guide rail (3).

The deformation guiding system (1) further comprises stabilising means (5) fixed to the head (2) for stabilising the head (2) so as to prevent oscillations of the head (2) about the guide rail (3).

Therefore in a case of an impact of a vehicle against the head (2), the coupling means (4) and the stabilising means (5) are reciprocally arranged and conformed so that the head (2) slides along the guide rail (3) without oscillating about the guide rail (3) so as to guide the deformation of the deformable body (12) along the relative deforming direction (X).

The head (2) can be made of steel. Further, the coupling means (4) can be made of steel and the stabilising means (5) can be made of steel.

The head (2), the coupling means (4) and the stabilising means (5) can be made in a single body.

Figure 2:
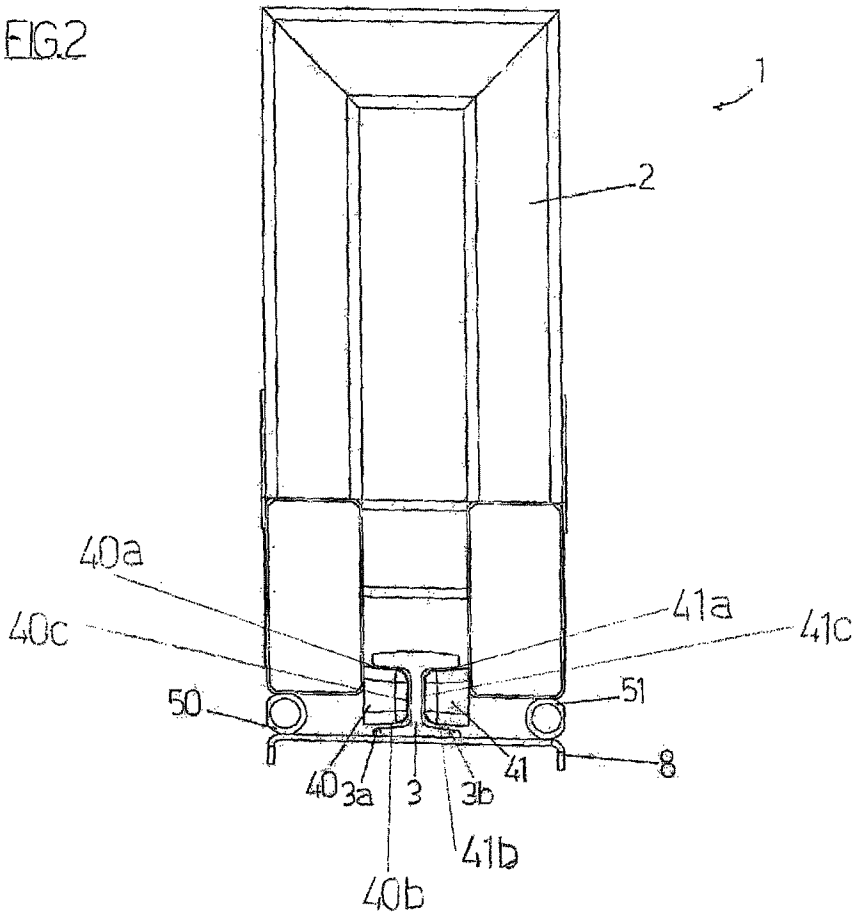
Figure 4:
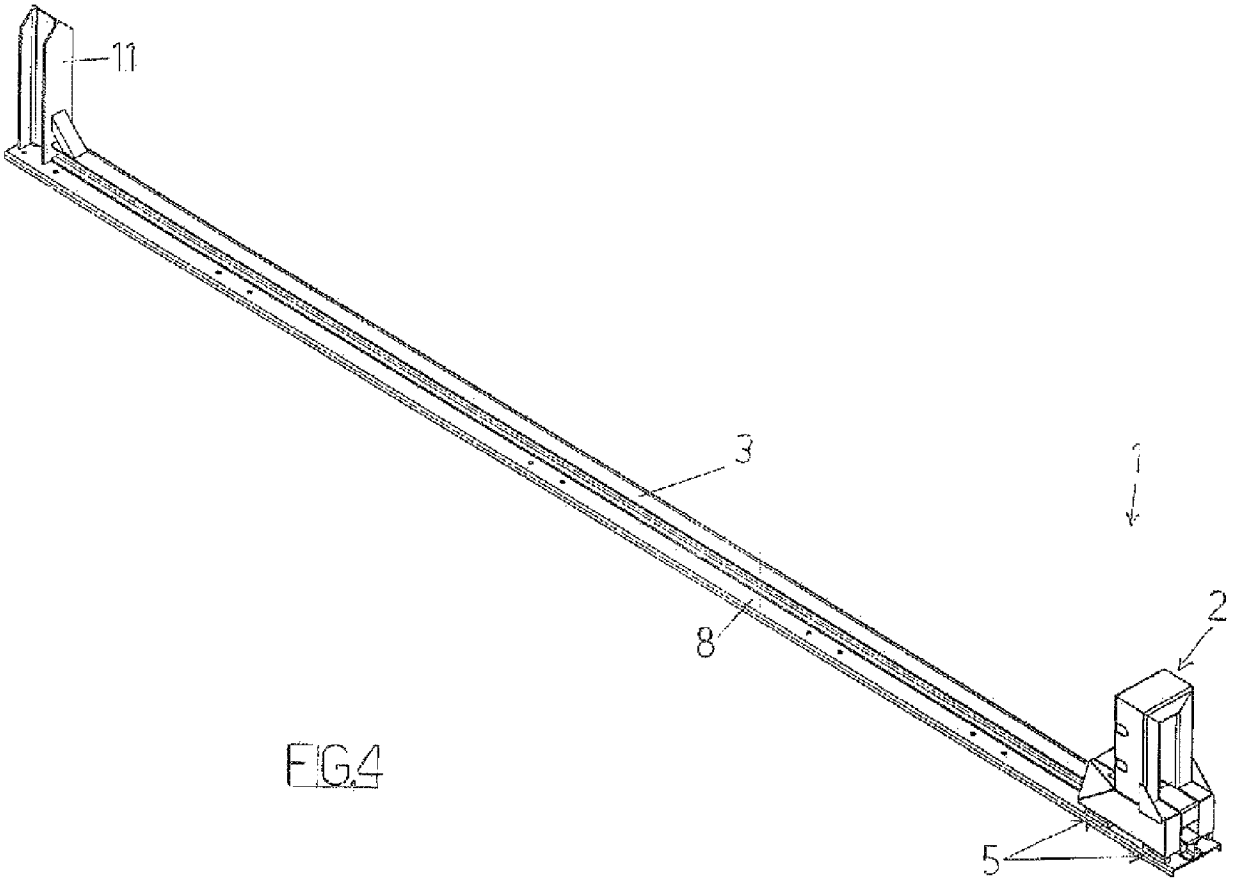
FIGS. 4 and 5 are perspective views of a guiding system of the deformation of the present invention in which the head is illustrated in different operating positions.
Figure 5:
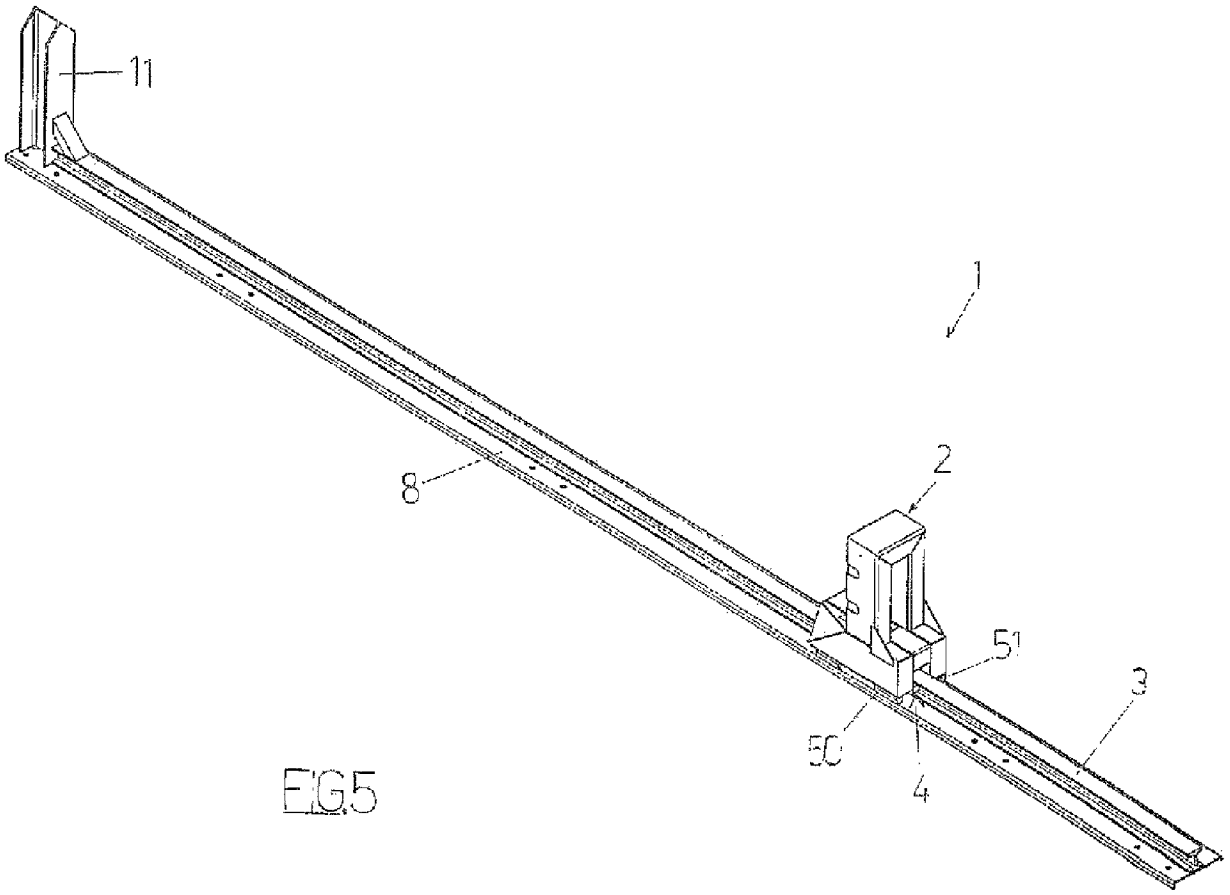

With reference to FIGS. 2, 4 and 5, the guide rail (3) preferably has a double T-shaped transversal section and defines a first cavity (3*a*) and a second cavity (3*b*). The coupling means (4) can comprise a first coupling element (40) and a second coupling element (41) conformed such as to insert, respectively, in the first cavity (3*a*) and the second cavity (3*b*), realising a form coupling between the coupling means (4) and the guide rail (3).

The form coupling between the coupling means (4) and the guide rail (3) advantageously optimises the sliding of the head (2) along the guide rail (3).

Therefore, in accordance with the above-cited embodiment, the first cavity (3*a*) and the second cavity (3*b*) of the guide rail (3) each have a C-shaped transversal section.

In detail, the first cavity (3*a*) and the second cavity (3*b*) can each comprise a first wall, a second wall and a third wall which connects the first wall and the second wall and which is transversal to the first wall and to the second wall (preferably the third wall is perpendicular to the first wall and to the second wall).

In particular the first coupling element (40) can be conformed so as to comprise, in turn: a first wall (40*a*) which faces the first wall of the first cavity (3*a*); a second wall (40*b*) which faces the second wall of the first cavity (3*a*); a third wall (40*c*) which connects the first wall (40*a*) and the second wall (40*b*) of the first coupling element (40) and which faces the third wall of the first cavity (3*a*).

In detail, the first wall (40*a*), the second wall (40*b*) and the third wall (40*c*) of the first coupling element (40) will be destined to respectively abut the first wall, the second wall and the third wall of the first cavity (3*a*).

Likewise the second coupling element (41) can be conformed so as to comprise, in turn: a first wall (41*a*) which faces the first wall of the second cavity (3*b*); a second wall (41*b*) which faces the second wall of the second cavity (3*b*); a third wall (41*c*) which connects the first wall (41*a*) and the second wall (41*b*) of the second coupling element (41) and which faces the third wall of the second cavity (3*b*).

In detail, the first wall (41*a*), the second wall (41*b*) and the third wall (41*c*) of the second coupling element (41) will be destined to respectively abut the first wall, the second wall and the third wall of the second cavity (3*b*). Alternatively to the above-described embodiment of the double-T shaped guide rail (3), the guide rail (3) might have a T-shaped transversal section. In this case, the first cavity (3*a*) and the second cavity (3*b*) are defined by the guide rail (3) and by the ground/rest plane of the guide rail (3).

The coupling means (4) can comprise, as well as the first coupling element (40) and the second coupling element (41), a third coupling element conformed for inserting in the first cavity (3*a*) and a fourth coupling element conformed for inserting in the second cavity (3*b*).

This advantageously enables reducing the contact surface between the coupling means (4) and the guide rail (3) given an equal sliding ability of the head (2).

It is understood that the third coupling element can be conformed like the first coupling element (40) and that the fourth coupling element can be conformed like the second coupling element (41).

The frame (11) of the road safety device can comprise a portion which forms a box structure to which the first end (12*a*) of the deformable body (12) is fixed (FIG. 1).

With further reference to FIG. 1, the deformation guiding system (1) preferably comprises a longitudinal plate (8) fixed to the road surface, the guide rail (3) being fixed to the plate (8). The stabilising means (5) can be arranged in such a way as to be able to contact the plate (8) and slide thereon in a case of an impact of a vehicle against the head (2).

In a case of an impact of a vehicle against the head (2), the stabilising means (5) can advantageously slide on the smooth and regular surface of the plate (8): this further facilitates the guiding of the deformation of the deformable body (12) along the relative deforming direction (X).

The stabilising means (5) might be conformed for rolling on the plate (8). The stabilising means (5) are preferably conformed for dragging on the plate (8) (see the figures).

Figure 3:
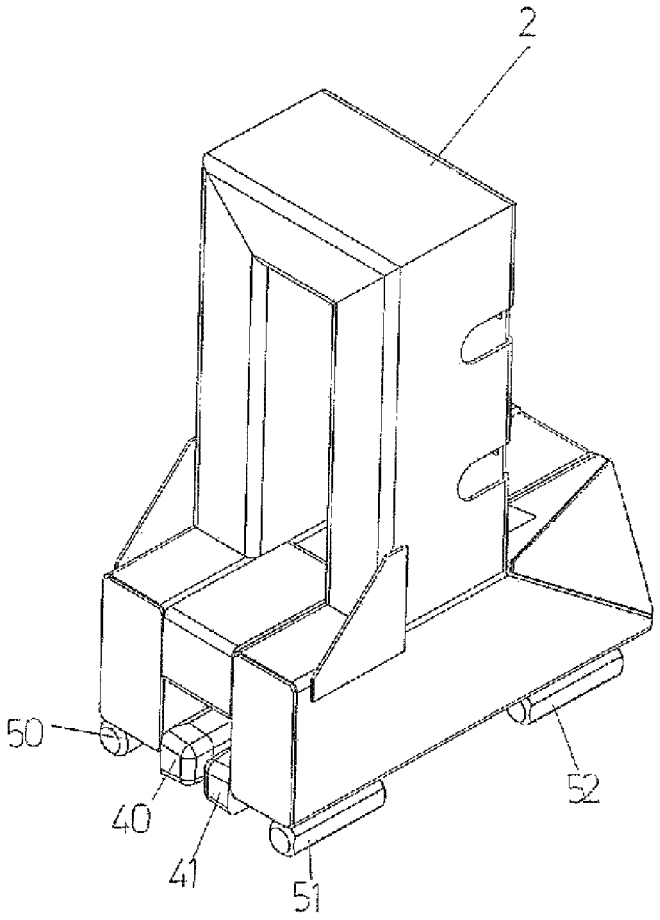
FIG. 3 is a perspective view of the head, the coupling means and the stabilising means of a guiding system of the deformation that is the object of the present invention.

The stabilising means (5) can comprise a first stabilising element (50) and a second stabilising element (51) which are fixed to the head (2) so as to be arranged on opposite sides with respect to the guide rail (3) (FIGS. 2 and 3). The first stabilising element (50) and the second stabilising element (51) can be conformed so as to drag on the plate (8) of the frame (11).

The first stabilising element (50) and the second stabilising element (51) can advantageously be made simply as rods (for example steel rods).

The stabilising means (5) can comprise, apart from the first stabilising element (50) and the second stabilising element (51), a third stabilising element and a fourth stabilising element (52) which is arranged on the opposite side of the guide rail (3) with respect to the third stabilising element.

The contact surface between the stabilising means (5) and the ground and/or the plate (8) is advantageously reduced.

The head (2) can have a substantially parallelepiped shape and have a length in a parallel direction to the guide rail (3), a width in a perpendicular direction to the guide rail (3) and a height. The height is preferably greater than the width.

The road impact attenuator (1) preferably comprises a single guide rail (3) and the coupling means (4) are conformed so as to slidably couple the head (2) to the single guide rail (3).

With reference to FIG. 1, the road safety device group (100) object of the present invention comprises: a road safety device which comprises a frame (11) connected to the road surface and a deformable longitudinal body (12) which comprises a first end (12*a*) fixed to the frame (11) and a second end (12*b*) opposite the first end (12*a*); a deformation guiding system (1) according to any one of the above-described embodiments, wherein the head (2) is fixed to the second end (12*b*) of the deformable body (12) of the road safety device.

The head (2) is preferably conformed so a to have a greater height with respect to the deformable body (12) so as to cover the second end (12*b*) of the deformable body (12).

This conformation of the head (2) advantageously optimises the guiding of the deformable body (12) along the relative deforming direction (X).

The deformable body (12) can be made of sheet metal.

The deformable body (12) can have a circular or hexagonal transversal section.

The road safety device group can further comprise: a plurality of sliding supports (8) for supporting the deformable body (12), which sliding supports (8) are conformed for slidably engaging with the guide rail (3).

In a case in which the deformable body (12) has a certain length the sliding supports (8) advantageously prevent, in a case of impact, the deformable body (12) collapsing towards the ground.

The invention claimed is:

1. A deformation guiding system for a road safety device, which road safety device comprises a frame connected to the road surface and a deformable longitudinal body which comprises a first end fixed to the frame and a second end opposite the first end, in which the deformation guiding system comprises:

a head fixable to the second end of the deformable body;

a straight guide rail, which guide rail and the deformable body are reciprocally arranged in such a way as to identify a deforming direction of the deformable body of the road safety device which is parallel to the straight guide rail; coupling means fixed to the head for coupling the head to the guide rail so that the head can slide along the guide rail; and stabilising means fixed to the head for stabilising the head so as to prevent oscillations of the head about the guide rail, the coupling means and the stabilising means being reciprocally arranged and conformed so that, in a case of an impact of a vehicle against the head, the head slides along the guide rail without oscillating about the guide rail so as to be able to guide the deformation of the deformable body along the relative deforming direction, wherein:

the guide rail has a double T-shaped transversal section and defines a first cavity and a second cavity; and the coupling means comprise a first coupling element and a second coupling element conformed such as to insert, respectively, in the first cavity and the second cavity, realising a form coupling between the coupling means and the guide rail.

2. The deformation guiding system of claim 1, further comprising a longitudinal plate fixed to the road surface, the guide rail being fixed to the plate, and wherein the stabilising means are arranged in such a way as to be able to contact the plate and slide thereon in a case of an impact of a vehicle against the head.

3. The deformation guiding system of claim 2, wherein the stabilising means comprise a first stabilising element and a second stabilising element which are fixed to the head so as to be arranged on opposite side with respect to the guide rail; the first stabilising element and the second stabilising element being conformed so as to drag on the plate.

4. The deformation guiding system of claim 1, comprising a single guide rail and wherein the coupling means are conformed so as to slidably couple the head to the single guide rail.

5. A road safety device group, comprising: a road safety device which comprises a frame connected to the road surface and a deformable longitudinal body which comprises a first end fixed to the frame and a second end opposite the first end; a deformation guiding system according to claim 1 wherein the head is fixed to the second end of the deformable body of the road safety device.

6. A road safety device group according to claim 5, wherein the head is conformed so as to have a greater height with respect to the deformable body so as to cover the second end of the deformable body.

7. The deformation guiding system of claim 1, wherein:

the first cavity and the second cavity of the guide rail each have a C-shaped transversal section and each comprises a first wall, a second wall and a third wall, the third wall connecting the first wall and the second wall to one another and extending transversely to the first wall and to the second wall;

the first coupling element comprises a first wall which faces the first wall of the first cavity, a second wall which faces the second wall of the first cavity, a third wall which connects the first wall and the second wall of the first coupling element and which faces the third wall of the first cavity;

the first wall, the second wall and the third wall of the first coupling element abut the first wall, the second wall and the third wall of the first cavity;

the second coupling element comprises a first wall which faces the first wall of the second cavity, a second wall which faces the second wall of the second cavity, a third wall which connects the first wall and the second wall of the second coupling element and which faces the third wall of the second cavity; and the first wall, the second wall and the third wall of the second coupling element abut the first wall, the second wall and the third wall of the second cavity.

* * * * *